United States Patent [19]

Jhaveri et al.

[11] Patent Number: 4,766,949

[45] Date of Patent: Aug. 30, 1988

[54] HOT BOX PROCESS FOR PREPARING FOUNDRY SHAPES

[75] Inventors: Satish S. Jhaveri, Oakville, Canada; William R. Dunnavant, Columbus; James T. Schneider, Dublin, both of Ohio

[73] Assignee: Ashland Oil, Inc., Russell, Ky.

[21] Appl. No.: 48,097

[22] Filed: May 8, 1987

[51] Int. Cl.[4] ..... B22C 1/22

[52] U.S. Cl. ..... 164/526; 106/38.2; 523/145

[58] Field of Search ..... 164/526, 527; 106/38.2; 523/145, 146, 147

[56] References Cited

U.S. PATENT DOCUMENTS

| | | | |
|---|---|---|---|
| 4,381,354 | 4/1983 | Kai et al. | 164/527 |
| 4,426,467 | 1/1984 | Quist et al. | 523/145 |
| 4,468,359 | 8/1984 | Lemon et al. | 523/145 |
| 4,474,904 | 10/1984 | Lemon et al. | 523/146 |
| 4,495,316 | 1/1985 | Armbruster | 523/145 |
| 4,644,022 | 2/1987 | Iyer | 523/145 |

*Primary Examiner*—Nicholas P. Godici
*Assistant Examiner*—Richard K. Seidel
*Attorney, Agent, or Firm*—David L. Hedden

[57] ABSTRACT

The subject invention relates to a hot box process for forming foundry shapes. The foundry shapes are formed with a mixture of an aggregate and certain aqueous basic solutions of phenolic resole resins which act as binders. The use of these binders results in foundry shapes which are cured by heating at elevated temperatures without requiring an acid-generating curing catalyst.

16 Claims, No Drawings

HOT BOX PROCESS FOR PREPARING FOUNDRY SHAPES

TECHNICAL FIELD

The subject invention relates to a hot box process for forming foundry shapes. The foundry shapes are formed with a mixture of an aggregate and certain aqueous basic solutions of phenolic resole resins which act as binders. The use of these binders results in foundry shapes which are cured by heating at elevated temperatures without requiring that an acid-generating curing catalyst be applied to the aggregate as a separate component.

BACKGROUND

It is known that workable foundry shapes can be prepared by the so called "hot box" process. This process involves injecting a mixture of a foundry aggregate containing an acid-generating curing catalyst and a thermosetting resin into a heated corebox where it is allowed to harden into a workable foundry shape, which is then removed from the corebox.

The hot box process requires that the acid-generating curing catalyst and thermosetting resin be mixed with the aggregate as separate components. The use of this process can cause the formation of undesirable smoke and fumes as well as significant amounts of nitrogen which can result in the formation of casting defects (pinholes) when metal castings are prepared.

SUMMARY OF THE INVENTION

This invention relates to a process for preparing a workable foundry shape comprising A. injecting a heat curable mixture comprising
   1. a foundry aggregate, and
   2. an effective binding amount of a binder comprising an aqueous basic solution of a phenolic resole resin wherein said aqueous basic solution has
   a. a viscosity of less than about 850 centipoise at 25° C.;
   b. a solids content of about 35 to about 75 percent by weight, said weight based upon the total weight of the basic solution; and
   c. an equivalent ratio of base to phenol of about 0.2:1.0 to 1.1:1.0;

into a corebox heated to a temperature sufficient to cure said mixture;

B. allowing said mixture to to harden into a workable shape;

C. removing said workable shape from the corebox.

For purposes of this invention, the term corebox shall be construed to include a mold box.

The use of the aqueous basic solutions of phenolic resole resins in a hot box process is advantageous because they contain little, if any, nitrogen and no significant amounts of free formaldehyde. Consequently, they produce little odor or fumes when foundry mixes and castings are prepared. The absence or minimization of nitrogen also is believed to reduce the likelihood of forming casting defects (pinholes). The aqueous solutions are also sufficiently stable at room temperature for industrial purposes, and produce water soluble cores which can be removed from the corebox even when release agents are not used.

Another significant advantage of the process is that it does not require an acid-generating catalyst to cure the workable foundry shapes. Workable shapes of sufficient tensile strength can be prepared merely by injecting the heat curable mixture into the heated corebox. This enables the user of the process to use a one component binder system to mix with the aggregate.

Although an acid generating catalyst could be added, it is not believed that there would be any catalytic effect on the curing process unless it is added in amounts which would be excessive according to usual practice. Therefore, another aspect of this invention relates to the process which is carried out in the absence of catalytic amount of acid-generating curing catalyst. In this situation a catalytic amount is an amount which significantly affects the curing rate of the process, and may be an excessive amount according to usual practice.

Other aspects of the invention relate to the foundry shapes prepared by the process; a process of casting metals using the foundry shapes; and metal castings produced by the metal casting process.

BEST MODE AND OTHER MODES FOR CARRYING OUT THE INVENTION

Foundry mixtures used in the process are prepared by mixing a foundry aggregate with an effective binding amount of an aqueous basic solution of a phenolic resole resin.

An effective binding amount of the aqueous basic solution of phenolic resole resin is generally from 0.5 weight percent to 7.0 weight percent of solution, based upon the weight of the aggregate, usually from 1.0 weight percent to 3.0 weight percent of binder.

The aggregate used to prepare the foundry mixture is that typically used in the foundry industry for such prrposes or any that will work for such purposes. Generally the aggregate will be sand which contains at least 70 percent by weight silica. Other suitable aggregate materials include zircon, olivine, alumina-silicate sand, chromite sand, and the like. Generally, the particle size of the aggregate is such that at least 80 percent by weight of the aggregate has an average particle size between 50 and 150 mesh (Tyler Screen Mesh).

Aqueous basic solutions of phenolic resole resins are prepared by methods well known in the foundry art. The general procedure involves reacting an excess of aldehyde with a phenolic compound in the presence of a base at temperatures of about 50° C. to 120° C., typically from 70° C. to 100° C., to prepare a phenolic resole resin. Generally the reaction will also be carried out in the presence of water. The resulting phenolic resole resin is diluted with a base and/or water so that an aqueous basic solution of the phenolic resole resin results having the following characteristics:

1. a viscosity of less than about 850 centipoise, preferably less than about 450 centipoise at 25° C. as measured with a Brookfield viscometer, spindle number 3 at number 12 setting;

2. a solids content of 35 percent by weight to 75 percent by weight, preferably 50 percent by weight to 60 percent by weight, based upon the total weight of the aqueous basic solution, as measured by a weight loss method by diluting 0.5 gram of aqueous resole solution with one milliliter of toluene and then heating on a hotplate at 150° C. for 15 minutes; and 3. an equivalent ratio of base to phenol of from 0.2:1 to 1.1:1.0, preferably from 0.3:1.0 to 0.95:1.0.

As an alternative to the procedure outlined, it may be possible to prepare the aqueous basic solutions by dissolving all of the base in phenol and then reacting with formaldehyde until the desired properties are achieved.

It has been found that aqueous basic solutions having viscosities outside the cited range are difficult to use in hot box equipment. Aqueous basic solution with a solids content below the cited range will not sufficiently coat the aggregate while those having a solids content above the cited range will not be sufficiently flowable in the molding equipment. The equivalent ratio specified for the base relates to the need for having solutions which have adequate shelf stability.

Although these ranges have been specified, it should be pointed out that it is not claimed that these aqueous basic solutions are novel products, or that the ranges are critical. The ranges are set forth to provide guidelines for those who want to make and use the invention. Obviously, the invention will usually be practiced more effectively in the preferred ranges specified. With this in mind, more specific procedures will be set forth for preparing phenolic resole resins.

The phenolic compounds used to prepare the phenolic resole resins can be represented by the following structural formula:

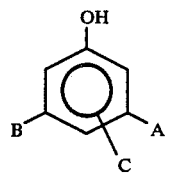

wherein A, B, and C are hydrogen, or hydrocarbon radicals or halogen.

The aldehyde used in preparing the phenolic resole resin may also vary widely. Suitable aldehydes include aldehydes such as formaldehyde, acetaldehyde, propionaldehyde, furfuraldehyde, and benzaldehyde. In general, the aldehydes used have the formula RCHO, where R is a hydrogen or a hydrocarbon radical of 1 to 8 carbon atoms. The most preferred aldehyde is formaldehyde.

The basic catalysts used in preparing the phenolic resole resin include basic catalysts such as alkali or alkaline earth hydroxides, and organic amines. The amount which is used depends upon the specific properties desired and the process utilized. Those skilled in the art are familiar with these amounts.

It is possible to add modifiers such as lignin and urea when preparing the phenol-formaldehyde resole resins as long as the amount is such that it will not detract from achieving the desired properties of the aqueous basic solutions. Often the urea is added as a scavenger to react with unreacted formaldehyde and remove the odor caused by it.

The phenolic resole resins used in the practice of this invention are generally made from phenol and formaldehyde at a mole ratio of formaldehyde to phenol in the range of from about 1.1:1.0 to about 3.0:1.0. The most preferred mole ratio of formaldehyde to phenol is a mole ratio in the range of from about 1.4:1.0 to about 2.2:1.0.

As was mentioned previously, the phenolic resole resin is either formed in the aqueous basic solution, or it is diluted with an aqueous basic solution. The base used in the aqueous basic solution is usually an alkali or alkaline earth metal hydroxide such as potassium hydroxide, sodium hydroxide, calcium hydroxide, or barium hydroxide, preferably potassium hydroxide. It should again be mentioned that the aqueous basic solutions described herein are not novel products, nor is their preparation. The parameters set forth pertaining to their preparation are merely guidelines for those who want to make the aqueous basic solutions. There may be other ways to make them not described herein.

Curing is accomplished by injecting the foundry mix into a core box which has been heated to a temperature sufficient to cure the foundry mix and produce a workable foundry shape. Generally the temperature needed to cure the foundry mix is from 200° C. to 300° C., preferably from 230° C. to 260° C. workable foundry shape is one which can be handled without breaking. Generally, the foundry mix must reside in the corebox from 15 seconds to 120 seconds, usually from 30 second to 90 seconds to produce a workable foundry shape.

It will be apparent to those skilled in the art that other additives such as silanes, silicones, benchlife extenders, release agents, solvents, etc. can be used and are preferably added to the binder compositions, although they can be added to the aggregate or foundry mix.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

EXAMPLES

The examples which follow will illustrate specific embodiments of the invention. They are not intended to imply that the invention is limited to these embodiments. The temperatures in the examples are in degrees Centigrade and the parts are parts by weight unless otherwise specified.

In the examples, the following aqueous alkaline solutions of phenolic resole resins were used to prepare foundry mixes:

RESIN A (aqueous solution)

A 1.0:1.53 phenol-formaldehyde base catalyzed resole condensate is prepared by heating a stirred mixture of 300.6 grams of phenol, 161.28 grams of 91% paraformaldehyde, 110.8 grams of water and 6.9 grams of 50% sodium hydroxide solution in 30 minutes to 80° C. To this mixture is added 2.3 grams of 50% sodium hydroxide solution and heating is continued at 90°-100° C. for 20 minutes. To this reaction mixture, 105.4 grams of 50% sodium hydroxide solution is added over a 15 minute period, the mixture is then held at 80°-85° C. for 45 minutes and is then cooled to room temperature. The resulting aqueous phenolic resole solution, after a dilution with 20 weight percent of water, has a 52.6 percent solids-content and a viscosity of 130 c.p.s. @25° C. The resole solution has an equivalent ratio of base to phenol of about 0.44:1.0.

RESIN B (aqueous solution)

A 1.0:1.7 phenol-formaldehyde base catalyzed resole condensate is prepared by warming a stirred mixture of 581.22 grams of phenol, 631.80 grams of 50% formaldehyde solution, 128.50 grams of water and 53.10 grams of methanol to 45° C. To this mixture is added 23.13 grams of 50% sodium hydroxide solution and the temperature is allowed to exotherm, but not exceed 80° C. After the exotherm has subsided, 23.13 grams of 50% sodium hydroxide solution is added and the temperature is held at 83° C. for 2 hours. The mixture is then cooled to 70° C. and 107.64 grams of 50% potassium hydroxide solution is added over 30 minutes while allowing the temperature to rise to 83° C. applying heat when necessary. The reaction is continued at 83° C. until a refractive index of 1.4900 is reached, then is cooled to 60° C. and 377.10 grams of potassium hydroxide solution is added and agitation is continued for 20 minutes at 60° C. before cooling to room temperature. The resulting resole solution has a 53% solids-content and a viscosity of 150 c.p.s. @25° C. The resole solution has an equivalent ratio of base to phenol of about 0.78:1.0.

RESIN C (aqueous solution)

A 1.0:2.0 phenol-formaldehyde base catalyzed resole condensate is prepared by heating a stirred mixture of 542.7 grams of phenol, 379.9 grams of 91% paraformaldehyde, 437.8 grams of water and 22.61 grams of 50% potassium hydroxide solution to 60° C. and allowing it to exotherm to 80° C. The reaction mixture is held at 80° C. for 30 minutes, is then cooled to 70° C. and 22.61 grams of 50% potassium hydroxide solution is added slowly with cooling to keep the temperature below 75° C. At the end of the addition, the temperature is raised to 85° C. and held at that temperature for 50 minutes. The mixture is then cooled to room temperature and 394.4 grams of 50% potassium hydroxide solution is added with thorough mixing. The resulting aqueous resole solution has a 53% solids-content and a viscosity of 117 c.p.s. at 25° C. The resole solution has an equivalent ratio of base to phenol of about 0.67:1.0

Foundry mixes were prepared with Manley 1L5 sand by mixing two percent by weight of the aqueous solutions of phenolic resole resin with the sand, the weight percent being based upon the weight of the sand. It appeared that the sand was effectively coated with the resin solution.

The resulting foundry mixes were forced by air blowing the mix into a standard AFS core box (dog bone shape) which had been heated to a temperature of 232° C. The tensile strengths (in psi) for various samples after being taken from the core box at specified dwell times (dwell times were 30, 40, 60 and 90 seconds), are given in Table I. The hot tensile measurements were taken within 10 seconds after removing the shapes from the core box. The cold tensiles were measured at least 1 hour after removing the shapes from the corebox.

The examples show that workable foundry shapes were formed under the conditions tested. It also appeared that the foundry mixes tested had sufficient flowability.

TABLE I (Sand Tests of Aqueous Phenolic Hot Box Binders)

| Example (Dwell time/sec) | Aqueous Solution | Hot Tensile (psi) | | | | Cold Tensile (psi) | | | |
|---|---|---|---|---|---|---|---|---|---|
| | | (30) | (40) | (60) | (90) | (30) | (40) | (60) | (90) |
| 1 | A | — | — | 59 | 115 | — | — | 112 | 208 |
| 2 | B | — | 53 | 85 | — | — | 127 | 181 | — |
| 3 | B | 22 | 35 | 67 | — | 78 | 88 | 145 | — |
| 4 | B | 27 | 33 | 46 | — | 127 | 142 | 143 | — |
| 5 | B | 21 | — | 79 | 112 | 62 | — | 175 | 288 |
| 6 | C | 35 | — | 79 | 100 | 80 | — | 186 | 229 |

We claim:

1. A process for preparing a workable foundry shape comprising;

A. injecting a heat curable mixture comprising 1. a foundry aggregate, and 2. an effective binding amount of a binder comprising an aqueous basic solution of a phenolic resole resin wherein said aqueous basic solution has a. a viscosity of less than about 850 centipoise at 25° C.;

b. a solids content of about 35 to about 75 percent by weight, said weight based upon the total weight of the basic solution; and c. an equivalent ratio of base to phenol of about 0.2:1.0 to 1.1:1.0;

into a corebox heated to a temperature sufficient to cure said mixture; in the absence of a catalytic amount of an acid-generating curing catalyst B. allowing said mixture to to harden into a workable shape;

C. removing said workable shape from the corebox.

2. The process of claim 1 wherein the equivalent ratio of base to phenol used in preparing the aqueous basic solution is from 0.3:1.0 to 0.95:1.0.

3. The process of claim 2 wherein the base is selected from the group consisting of sodium hydroxide, potassium hydroxide, and mixtures thereof.

4. The process of claim 3 where the viscosity of the phenolic resin is from less than about 450 centipoise at 25° C.

5. The process of claim 4 wherein the phenolic resole resin is prepared by reacting formaldehyde and phenol in a mole ratio of formaldehyde to phenol of about 1.1:1.0 to about 2.2:1.0 in the presence of an effective amount of a basic catalyst at elevated temperatures of about 50° C. to about 120° C.

6. The process of claim 4 wherein the temperature of the corebox is from 230° C. to 260° C.

7. The process of claim 6 wherein the amount aqueous solution used is from 1 percent by weight to 3 percent by weight, based upon the weight of the aggregate.

8. The process of claim 7 wherein the aggregate is sand.

9. A process for casting a metal part comprising;

(a) forming a workable foundry shape according to claim 1;

(b) pouring molten metal into or around said shape;

(c) allowing said metal to cool and solidify; and (d) removing the metal part.

10. A process for casting a metal part comprising;

(a) forming a workable foundry shape according to claim 2;

(b) pouring molten metal into or around said shape;

(c) allowing said metal to cool and solidify; and (d) removing the metal part.

11. A process for casting a metal part comprising;

(a) forming a workable foundry shape according to claim 3;

(b) pouring molten metal into or around said shape;

(c) allowing said metal to cool and solidify; and (d) removing the metal part.

12. A process for casting a metal part comprising;

(a) forming a workable foundry shape according to claim 4;
(b) pouring molten metal into or around said shape;
(c) allowing said metal to cool and solidify; and
(d) removing the metal part.

13. A process for casting a metal part comprising;
(a) forming a workable foundry shape according to claim 5;
(b) pouring molten metal into or around said shape;
(c) allowing said metal to cool and solidify; and
(d) removing the metal part.

14. A process for casting a metal part comprising;
(a) forming a workable foundry shape according to claim 6;
(b) pouring molten metal into or around said shape;
(c) allowing said metal to cool and solidify; and
(d) removing the metal part.

15. A process for casting a metal part comprising;
(a) forming a workable foundry shape according to claim 7;
(b) pouring molten metal into or around said shape;
(c) allowing said metal to cool and solidify; and
(d) removing the metal part.

16. A process for casting a metal part comprising;
(a) forming a workable foundry shape according to claim 8;
(b) pouring molten metal into or around said shape;
(c) allowing said metal to cool and solidify; and
(d) removing the metal part.

* * * * *